US005584669A

United States Patent [19]

Becker

[11] Patent Number: 5,584,669

[45] Date of Patent: Dec. 17, 1996

[54] TWO-STAGE POSITIVE DISPLACEMENT PUMP

[75] Inventor: Erich Becker, Bad Krozingen, Germany

[73] Assignee: KNF Neuberger GmbH, Freiburg-Munzingen, Germany

[21] Appl. No.: 377,551

[22] Filed: Jan. 24, 1995

Related U.S. Application Data

[62] Division of Ser. No. 226,165, Apr. 11, 1994, Pat. No. 5,387,090.

[30] Foreign Application Priority Data

Apr. 15, 1993 [DE] Germany ..... 9305554 U
Jun. 24, 1993 [DE] Germany ..... 43 20 963.7

[51] Int. Cl.[6] ..... F04B 23/10

[52] U.S. Cl. ..... 417/205; 417/521

[58] Field of Search ..... 417/199.1, 205, 417/254, 413.1, 521, 203

[56] References Cited

U.S. PATENT DOCUMENTS

| | | | |
|---|---|---|---|
| 2,142,329 | 1/1939 | Nika, Jr. et al. | 417/199.1 |
| 2,413,851 | 1/1947 | Taylor | 417/199.1 |
| 2,592,940 | 4/1952 | Alonoyer . | |
| 3,145,914 | 8/1964 | Nicholas . | |
| 3,190,545 | 6/1965 | Weber et al. . | |
| 3,281,065 | 10/1966 | Chaffiotte . | |
| 3,578,880 | 5/1971 | Cygnor . | |
| 3,672,791 | 6/1972 | Zimmerly . | |
| 4,505,647 | 3/1985 | Alloca et al. . | |
| 5,190,444 | 3/1993 | Grinsteiner et al. | 417/199.1 |

FOREIGN PATENT DOCUMENTS

| | | |
|---|---|---|
| 2302425 | 8/1976 | France . |
| 2903786 | 8/1979 | Germany . |
| 8808819 | 10/1988 | Germany . |
| 3710782 | 10/1988 | Germany . |

OTHER PUBLICATIONS

English Translation of portions of German Office Action dated Jan. 10, 1994 in couterpart German Priority Application P 43 20 963.7–15.

"LABOVAC® Linear–Membranpumpen und Kolbenpumpen" Brochure of SASKIA Hochvakuum und Labortechnik GmbH.

"LABOVAC® D 65–D Dry Trochen Sec" Brochure of SASKIA Hochvakuum und Labortechnik GmbH.

*Primary Examiner*—Timothy Thorpe
*Assistant Examiner*—William Wicker
*Attorney, Agent, or Firm*—Panitch Schwarze Jacobs & Nadel, P.C.

[57] ABSTRACT

A two-stage positive displacement pump (1) is used in particular to operate in conjunction with a turbomolecular pump (2) that can be placed ahead of it in series. The two-stage positive displacement pump (1) is configured as a hybrid pump (3) that has on the medium-entry side a reciprocating pump (5) with a comparatively large displacement area (6), whereby its piston-cylinder space (7) is sealed off with respect to the crank area (8) by means of a sealing membrane (9). Also as a part of this two-stage positive displacement pump (1) which forms the hybrid pump (3), there is placed in series behind the reciprocating pump (5) a diaphragm pump (10), whose displacement area (11) is noticeably smaller compared to that of the reciprocating pump (5).

8 Claims, 2 Drawing Sheets

TWO-STAGE POSITIVE DISPLACEMENT PUMP

CROSS-REFERENCE TO RELATED APPLICATION

This application is a division of U.S. application Ser. No. 08/226,165, filed Apr. 11, 1994, now U.S. Pat. No. 5,387,090.

FIELD OF THE INVENTION

The invention involves a two-stage positive displacement pump, particularly with a turbomolecular pump that can be connected ahead of it in series.

BACKGROUND OF THE INVENTION

Two-stage reciprocating pumps are already known in which the two pistons are joined with each other by means of a piston rod and are driven by means of a linear drive (see the brochure "LABOVAC-Linear-Membranpumpen und Kolbenpumpen" [LABOVAC Linear Diaphragm Pumps and Reciprocating Pumps] from the firm of SASKIA, Hochvakuum—und Labortechnik GmbH [SASKIA High-Vacuum and Laboratory Engineering Co.], O-6300 Ilmenau, Germany). It is also mentioned there that, with special models, it is possible to achieve hermetic sealing of the pistons through the installation of a separating membrane. However, reciprocating pumps of this type, with or without a separating membrane, still have several disadvantages:

In the case of pistons causing expulsion, for example into open air, condensation can occur if there is corresponding moisture in the pumping medium. This leads to increased wear and to leakage at the piston seals. That means a decline in performance for the entire pumping unit.

Also already known is a reciprocating pump in which the piston-cylinder space is closed off down to the crank area by means of a sealing membrane. This prevents atmospheric air, for example, from being able to get past the piston rings or a lip seal of the piston and thereby somewhat degrading the vacuum generated in the reciprocating pump. This also prevents the disadvantage of the actual pumping medium itself becoming contaminated by possibly contaminated air coming from the crank area. It must also be noted that over the long run, a seal cannot be attained where the crankshaft comes through, and that because of the mechanical movement, some form of lubrication is necessary in the crank area. If the piston-cylinder space is not sealed off from the crank area, this also can contribute to unwanted impurities in the actual pumping medium.

From the brochure "LABOVAC D65–D1600" of the firm of SASKIA Hochvakuum—und Labortechnik GmbH, there is already the suggestion to use a linear-acting, two-stage reciprocating pump provided with two sliding pistons, as described above, as a fore-pump for a turbomolecular pump. However, this also brings several disadvantages with it. First of all, the known two-stage reciprocating pump with linear drive has the above-mentioned disadvantage of condensate formation. Secondly, it has no balancing of mass with respect to the movements of the pistons, or an expensive, additional mass balance must be provided.

When such a known two-stage, linear reciprocating pump works in conjunction with a turbomolecular pump, the usual vibrations lead to unwanted movements of the turbomolecular pump, which is usually joined with the two-stage reciprocating pump in a single frame, or is even made as a common pump block. The turbomolecular pump is, however, very sensitive to vibration. As is known, turbomolecular pumps of the known design types exhibit rotational speeds of, for example, 30,000 rpm or even rotational speeds that are substantially higher. The rotors of such turbomolecular pumps are therefore usually mounted in magnetic bearings, and are correspondingly sensitive to shocks.

SUMMARY OF THE INVENTION

Therefore, the object exists of constructing, in particular, a two-stage positive displacement pump in which, first of all, the unwanted condensate formation is avoided, namely at the outlet of the two-stage positive displacement pump. In addition, it should be possible to install the two-stage-positive displacement pump downstream of a turbomolecular pump, whereby on the one hand, the turbomolecular pump should not be impaired by impurities coming from the two-stage positive displacement pump, but on the other hand, should also not be impaired in its operating characteristics by shaking movements. At the same time, the two-stage positive displacement pump should also have a relatively high suction power, which is desirable for economic operation of the turbomolecular pump.

The solution in accordance with the invention in terms of a two-stage positive displacement pump consists particularly in constructing the pump as a hybrid pump which has, on the medium-entry side, a reciprocating pump with a comparatively large volumetric displacement, and whose piston-cylinder space is sealed off with respect to the crank area of this hybrid pump by means of a sealing membrane, and that with the hybrid pump, there is placed in series behind the reciprocating pump a diaphragm pump, the volumetric displacement of which is noticeably smaller compared to that of the reciprocating pump.

In the first place, by means of such a construction with the two-stage positive displacement pump as a hybrid pump, a relatively large suction volume is attained, but without the disadvantages of two conjoined, series-connected reciprocating pumps having to be taken into account. In particular, the harmful effects of condensate formation are prevented to the greatest extent possible by the diaphragm pump that is expelling the pumping medium, since the diaphragm pump is practically insensitive to the formation of condensation. In the second place, with the help of a reciprocating pump placed in the path of the pumping medium between the turbomolecular pump and the diaphragm pump, a relatively large volumetric displacement can be attained, and at the same time, the reciprocating pump can be designed with respect to its volume in such a way that the compressed reciprocating pump volume is matched to the suction volume of the diaphragm pump.

Through this combination of reciprocating pump and diaphragm pump, one can prevent the disadvantage that can arise through the use of two diaphragm pumps: Because of the previously mentioned difference in suction volumes of the two series-connected pumps, a diaphragm pump that is directly connected to a turbomolecular pump must have relatively large dimensions, which leads to large masses to be moved. It also brings with it certain disadvantages relative to the diaphragm configuration for a diaphragm pump which is adjacent to a turbomolecular pump.

In contrast, one attains optimum relationships with the innovative hybrid pump, that is with a combination of a reciprocating pump plus a diaphragm pump that follows this reciprocating pump in series. Above certain performance limitations, fore-pumps with two diaphragms are—as has been mentioned—no longer capable of optimum performance. In contrast studies have shown that fore-pumps that are to work in conjunction with turbomolecular pumps lie where two diaphragm pumps having equal displacement volumes connected one behind the other in series can no longer be built in an optimal fashion.

Additional further features of the invention, which are particularly advantageous, include the following: by at least approximately matching the displacement volumes of the hybrid pump, so that the expulsion volume of the reciprocating pump is at least approximately equal to the suction volume of the diaphragm pump, expediently at a certain operating vacuum, one attains particularly favorable relationships with respect to the suction capability of the two-stage positive displacement pump in accordance with the invention.

By connecting a turbomolecular pump in series in front of the reciprocating pump, at least in terms of the flow path, so that the intake port of the reciprocating pump is connected with the outlet of the turbomolecular pump, and possibly the housings of the turbomolecular pump and the two-stage positive displacement pump are connected with each other, one achieves an apparatus that includes a turbomolecular pump as well as a two-stage positive displacement pump that works in conjunction with it. By means of the combination of a turbomolecular pump with a reciprocating pump that is sealed off at the crank area and with a diaphragm pump that is connected in series behind this reciprocating pump, one can attain optimum relationships from an aggregate apparatus of this type by appropriate design of the reciprocating-pump and the diaphragm-pump volumes when taking into consideration the requirements of the turbomolecular pump.

By providing one or both pumps of the hybrid pump with floating (swinging) pistons, one attains, in conjunction with the sealing membrane that is part of the reciprocating pump, the advantage that the conveying paths for the medium do not come into contact with any lubricated parts. For example, in the areas of the reciprocating pump that are near the pumping, lubricated parts are no longer necessary at all, because with a floating piston, a piston (wrist) pin can be dispensed with. The two-stage positive displacement pump in accordance with the invention therefore allows absolute freedom from lubricants and similar impurities. This is especially advantageous when the turbomolecular pump is added to the entire aggregate, and this entire aggregate is used, for example, in the field of electronic component manufacture, particularly if absolute cleanliness is needed, for example in the vapor deposition of chips.

The production process which is here to be kept under vacuum by means of a complete aggregate, including the above combination of a hybrid pump with a turbomolecular pump, usually takes place under the influence of a protective gas. There, even very minute impurities result in significant problems. These can be prevented to the greatest possible extent by means of the two-stage positive displacement pump which includes a turbomolecular pump connected in front of it in series, as described above, and also by the possible provision of floating pistons in the hybrid pump, as also described above.

Studies have shown that a configuration in which the head of the piston of the reciprocating pump is provided with a disk-like sealing collar, which takes on a U-shaped cross-section upon insertion into the piston-cylinder space, is especially advantageous, and simple in design as well. By providing the diaphragm pump with a molded membrane which has a front side facing and matched to the neighboring pumping area wall, the advantage of minimal dead space is attained.

The provision of a common crankshaft for driving the reciprocating pump and the diaphragm pump, as well as aligning the pumps along their longitudinal axis, makes a balancing of the masses of the reciprocating parts easily possible, which leads to smooth running of the two-stage positive displacement pump. This holds true particularly in connection with the hybrid pump wherein the mass of all moving parts is at least approximately balanced relative to the reciprocating and diaphragm pumps. One can take all of the reciprocating masses into account when designing the pump, and thus achieve the smoothest possible running, which is especially valuable if—as already mentioned above—the two-stage positive displacement pump is working in conjunction with a turbomolecular pump, which is particularly sensitive to shaking movements. This holds especially true if the turbomolecular pump and the two-stage positive displacement pump are accommodated on a single frame or even in a common housing.

The provision of an extraction line between the line connecting the turbomolecular pump and the reciprocating pump intake, on the one hand, and the intermediate space between the floating piston head and its associate sealing membrane, on the other hand, makes a substantial contribution in that the intermediate space between the floating piston and its associated sealing collar on the one side and the sealing membrane on the other is evacuated to such an extent, even immediately upon startup of the hybrid pump, that an unwanted overflow from the displacement volume of the reciprocating pump into the intermediate space is dispensed with, or is at least prevented to the greatest extent possible. The two-stage positive displacement pump and, if present, the connected turbomolecular pump, are then ready for operations more quickly upon startup.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. Individual features of the embodiment of the invention may be used alone or all together. The drawings show, very schematically.

DETAILED DESCRIPTION OF PREFERRED EMBODIMENT

Figure 1:
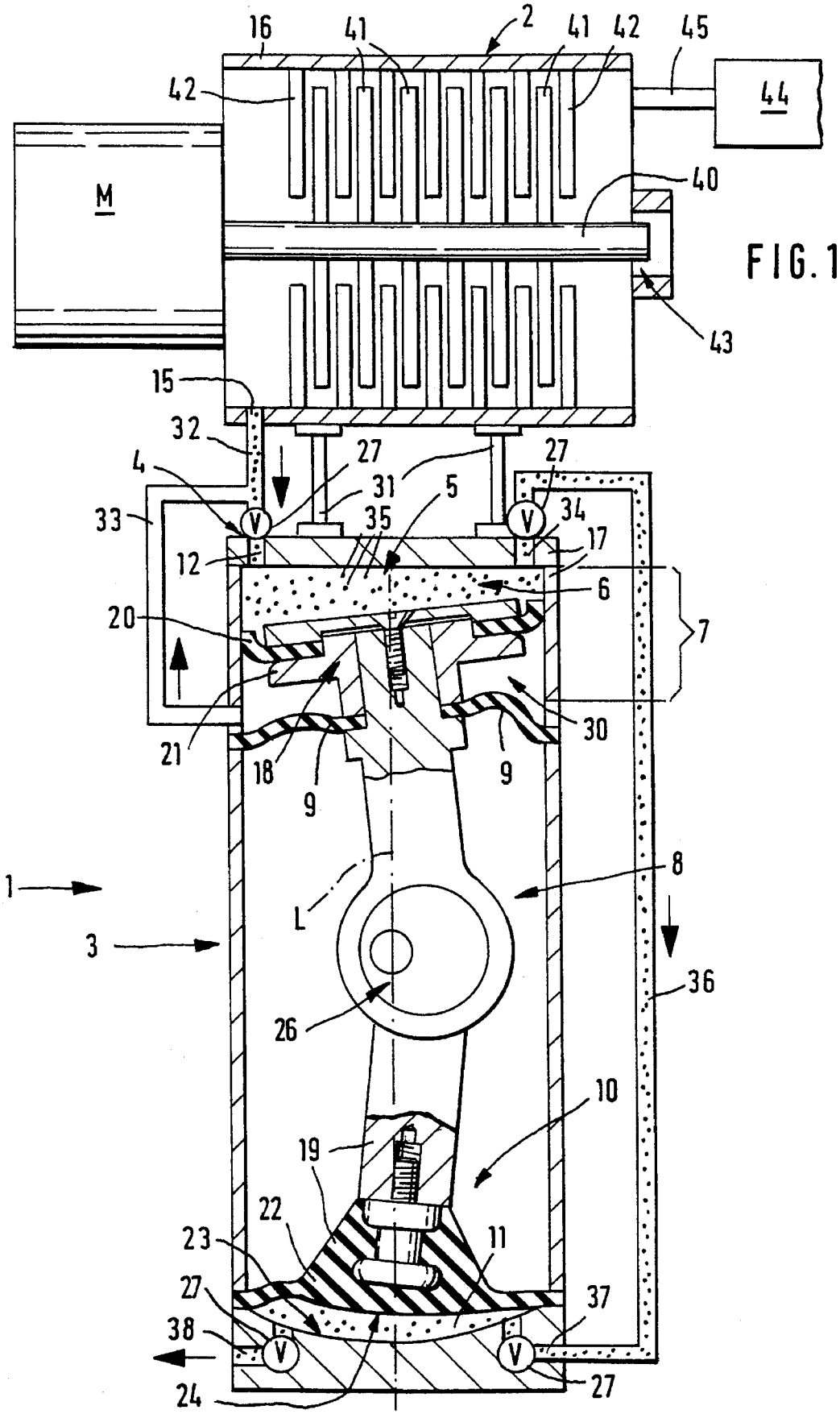
FIG. 1 is a side view, essentially in cross-section, of a two-stage positive displacement pump that is connected with a turbomolecular pump.

FIG. 1 shows a two-stage positive displacement pump 1 underneath a turbomolecular pump 2 that is connected with it. It is a part of the invention, that the two-stage positive displacement pump 1 is configured as a hybrid pump 3 having on the medium-entry side at 4 a reciprocating pump 5 with a comparatively large displacement volume 6, whereby its piston-cylinder space 7 is sealed off with respect to the crank area 8 of the hybrid pump 3 by means of a sealing membrane 9. It is also a part of the invention included in the hybrid pump 3, there is placed in series behind the reciprocating pump 5 a diaphragm pump 10, whose displacement area 11 is noticeably smaller compared to that of the reciprocating pump 5.

At the same time, in accordance with a particularly advantageous embodiment, the displacement volumes 6 and 11 of the hybrid pump 3 are at least approximately matched to each other in such a way that the expulsion volume of the reciprocating pump 5 at a specific operating vacuum is equal to the suction volume of the diaphragm pump 10. If so desired, the suction and expulsion volumes can also be matched to one another for an operational range in the sense of an optimization.

An especially advantageous combination results from the invention, if the two-stage positive displacement pump 1 works in conjunction with a turbomolecular pump 2 in such a way that the two-stage positive displacement pump 1 is placed in series behind the turbomolecular pump 2, at least in the flow path, and in such a way that the inlet port 12 of the reciprocating pump 5 is connected to the outlet 15 of the turbomolecular pump 2. In this regard, it is expedient if the turbomolecular pump 2 and the two-stage positive displacement pump 1 are connected with one another with respect to their housings 16 and 17, for example by means of a frame 31 that is shown only schematically in FIG. 1. The turbomolecular pump 2 and the two-stage positive displacement pump 1 can, of course, also be accommodated in a common housing (not shown).

In the embodiment shown, both of the pumps 5 and 10 of the two-stage positive displacement pump 1 are provided with floating pistons 18 and 19, and in the case of the reciprocating pump 5 of the two-stage positive displacement pump 1, a disk-like sealing collar 20 is attached at the piston head 21. This sealing collar 20 seals off the piston head 21 from the piston-cylinder space 7 of the reciprocating pump 5. Since the two-stage positive displacement pump 1 has, in the first place, a reciprocating pump 5, and in the second, a diaphragm pump 10, one speaks of a "hybrid pump 3". The diaphragm pump 10 of this hybrid pump 3 has a molded membrane 22, the front side 24 of which faces the neighboring pumping space wall 23 and is matched to it, so that only a practically minimal dead space results in the dead center position (lower part of FIG. 1).

The reciprocating pump 5 and the diaphragm pump 10 of the hybrid pump 3 are driven by a common crankshaft 26. The two pumps 5 and 10 are arranged opposite each other in the direction of the pump longitudinal axis L. For that reason, and because of the common drive by means of the crankshaft 26, a balancing of mass with respect to the pumping movement of the reciprocating pump 5 and the diaphragm pump 10 is easily possible. In this way, one obtains especially smooth running of the hybrid pump if a balancing of mass of all moving parts is provided for with respect to the reciprocating and diaphragm pumps 5 and 10.

In FIG. 1, one can see an additional extraction line 33 which goes from the connecting line 32, that leads from the turbomolecular pump 2 to the reciprocating pump intake port 12, and from there leads to the intermediate space 30, which is located between the piston head 21 of the reciprocating pump 5 on the one side and the associated sealing membrane 9, on the other side. By means of this extraction line 33, the intermediate space 30 is co-evacuated, particularly, when the hybrid pump 3 is started up. Leakages at the associated sealing collar 20 do not have a substantial or long-lasting effect, so that the reciprocating pump 5 causes the appropriate reduction of pressure at the desired intake volume even soon after the startup of the hybrid pump 3. From the outlet port 34 the pumping medium, which is indicated in FIG. 1 by dots 35 in pump 1, is fed via the pump line 36 to inlet 37 of the diaphragm pump 10. This diaphragm pump then expels at its outlet port 38, for example into open air, the medium conveyed from the hybrid pump 3 or the combined turbomolecular and hybrid pump 2, 3.

The manner of operation of the combined turbomolecular and hybrid pump 2, 3 can be explained especially clearly in terms of the startup procedure. This procedure takes place in the following way:

In the housing 16 of the turbomolecular pump 2, there is an impeller 40 that is connected with a motor M, which is indicated only schematically, and that has paddle wheels 41 of known construction. In the housing 16 are located, adjacent to the moving paddle wheels 41, guide disks 42 or the like. The impeller 40 of the turbomolecular pump runs at, for example, 30,000 rpm, but possibly even substantially faster than that, for example at about 60,000 rpm. Because of this high rotational speed, the mounting of the impeller is usually carried out by means of magnetic bearings 43, one of which is shown on the right side of FIG. 1.

Reference number 44 designates a space, container or the like that is to be evacuated by the turbomolecular and hybrid pumps 2, 3. This can be a region in which absolute cleanliness is essential, for example the area of a production process in which sensitive work procedures are to be carried out under the influence of a vacuum and/or protective gas, for example the vapor deposition of chips. From the space 44 a turbomolecular pump inlet 45 leads into this turbomolecular pump 2.

When a turbomolecular pump 2 of this type, which is known per se, starts up, it has little effect at first during the startup stage. Its pressure-side outlet 15 leads via the connecting line 32 into the displacement area 6 of the reciprocating pump 5. On the medium entry and exit sides the reciprocating pump 5, just like the diaphragm pump 10, is equipped with known vacuum valves 27, which are shown only schematically in FIG. 1. The formation of a vacuum is obtained in the usual way by means of the movement of the floating piston 18 in the displacement area 6. By means of the outlet valve 27 of the displacement area 6, the above-described extracted medium, which is usually air but can be other gases as well, is then fed via the pump line 36 to the intake port 37 of the diaphragm pump 10. This pump then, in the usual manner of operation, draws in gas, air or a similar medium, and expels it from its outlet port 38.

The sealing membrane 9 that is applied to the back side of the floating piston 18 of the reciprocating pump 5 prevents impurities from gaining entry into the medium region. From the intermediate space 30 the extraction line 33 leads to the connecting line 32, which connects the turbomolecular pump with the reciprocating pump 5. Possible leakages at the sealing collar 20 of the floating piston 18, and pumping medium that enters the intermediate space 30 as a result, can be fed back ahead of the suction valve 27 of the reciprocating pump 5 by means of this extraction line. This accelerates the extraction process in order to reach an operating vacuum.

The turbomolecular pump 2 only begins to become operationally effective when a certain minimum vacuum has been attained by the hybrid pump 3, which, in practical terms, represents a fore-pump for the turbomolecular pump 2. This pump then operates in conjunction with the hybrid pump 3 in the following manner: Because of the high speed of rotation of the moving paddle wheels 41 of the turbomolecular pump 2, molecules found inside its housing 16 obtain correspondingly high momentum and are moved away from the turbomolecular pump inlet 45 to its outlet 15, which leads to the desired increase of the vacuum, known per se for turbomolecular pumps. The molecules are, so to speak, mechanically transported in the direction of the outlet 15 of the turbomolecular pump by this momentum, whereby an increase in the vacuum occurs.

Significant advantages of the invention lie in the fact that the two-stage positive displacement pump 1, which serves as the fore-pump for the turbomolecular pump 2, is configured as a hybrid pump 3, whose reciprocating pump 5, that is adjacent—in terms of the flow of the medium—to the turbomolecular pump 2, creates relatively large suction volumes and is nevertheless protected from impurities and leakages, whereby, however, the reciprocating pump operates in conjunction with the output-side diaphragm pump 10 which, for its part, is not sensitive to condensation.

Figure 2:
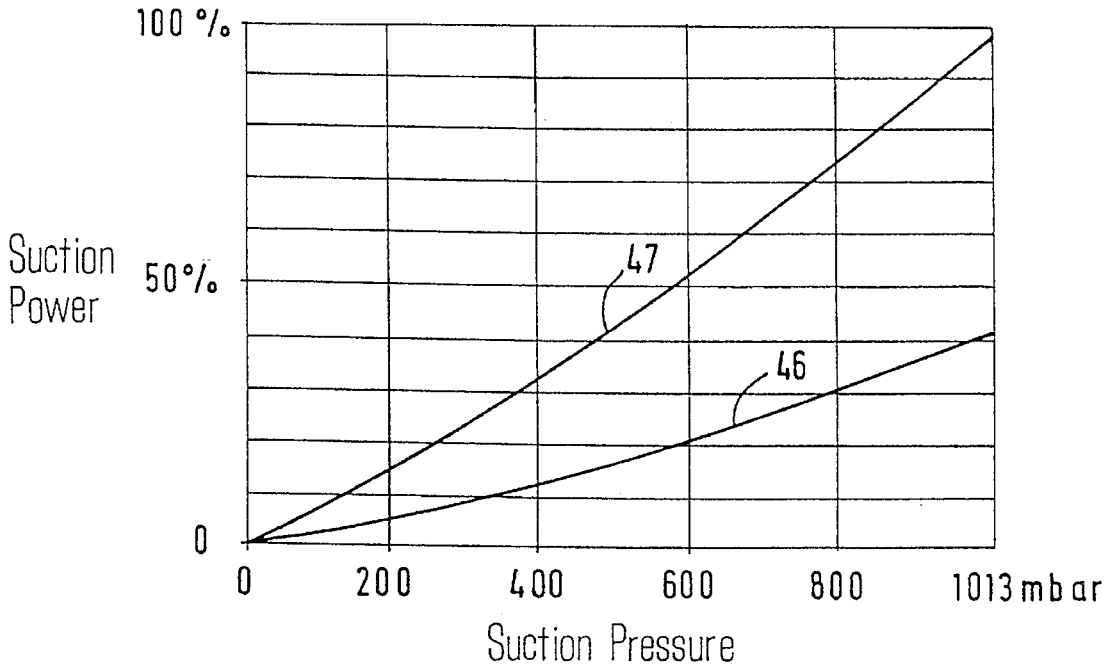
FIG. 2 is a schematic diagram in which, for two different kinds of pumps, the suction power of each is plotted against the suction pressure.

From FIG. 2 one can see the differences relative to the suction power of a normal two-stage diaphragm pump versus a two-stage hybrid pump 3. Curve 46 shows the suction power, plotted against the suction pressure, for a normal two-stage diaphragm pump. Curve 47 shows the curve of the suction power of a two-stage hybrid pump 3 of the invention with intake-side reciprocating pump 5 and output-side diaphragm pump 10. In a relatively simple way, one can obtain a substantial increase in suction power under conditions that are otherwise the same (suction pressure) if one connects in a two-stage hybrid pump an intake-side, larger displacement volume 6 in the above-described manner with a diaphragm pump 10, whereby possible disadvantages of the reciprocating pump 5 are prevented by means of the sealing membrane 9.

All of the features described above or cited in the claims can be fundamental to the invention either singly or in any desired combination. It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A two-stage positive displacement pump, said two-stage pump (1) being configured as a hybrid pump (3) comprising a reciprocating pump (5) and a diagram pump (10), said reciprocating pump being located on a side of the hybrid pump where pumping medium enters the hybrid pump, said reciprocating pump (5) having a comparatively large displacement volume (6) and a piston-cylinder space (7) which is sealed off with respect to a crank area (8) by means of a sealing membrane (9), and said diaphragm pump (10) being connected in series behind the reciprocating pump (5), said diaphragm pump having a displacement volume (11) which is appreciably smaller than that of the reciprocating pump (5).

2. A two-stage positive displacement pump according to claim 1, wherein the displacement volumes (6, 11) of the hybrid pump (3) are at least approximately matched to each other in such a way that, at a given operating vacuum, the reciprocating pump (5) has an expulsion volume which is at least approximately equal to the suction volume of the diaphragm pump (10).

3. A two-stage positive displacement pump according to claim 1, wherein at least one pump (5, 10) of the hybrid pump (3) comprises a floating piston (18, 19).

4. A two-stage positive displacement pump according to claim 1, wherein the reciprocating pump (5) of the hybrid pump (3) has a piston head with a sealing collar that, upon insertion into the piston-cylinder space (7), takes on a U-shaped cross-section.

5. A two-stage positive displacement pump according to claim 1, wherein the diaphragm pump (10) of the hybrid pump (3) has a molded membrane (22), with a front side (24) which faces an adjacent pumping area wall (23) and is matched in shape to it.

6. A two-stage positive displacement pump according to claim 1, wherein the reciprocating pump (5) and the diaphragm pump (10) of the hybrid pump (3) are driven by a common crankshaft (26).

7. A two-stage positive displacement pump according to claim 6, wherein the pumps (5, 10) are aligned in the direction of the hybrid pump's longitudinal axis (L).

8. A two-stage positive displacement pump according to claim 1, wherein the hybrid pump (3) is provided with at least an approximate balancing of mass of all of moving masses in rigard to the reciprocating pump (5) and the diaphragm pump (10).

* * * * *